United States Patent [19]

Ayre, Jr.

[11] Patent Number: 4,779,868

[45] Date of Patent: Oct. 25, 1988

[54] BOWLING ALLEY

[76] Inventor: Fred P. Ayre, Jr., 321 E. Fairview St., Bethlehem, Pa. 18017

[21] Appl. No.: 46,434

[22] Filed: May 6, 1987

Related U.S. Application Data

[63] Continuation-in-part of Ser. No. 808,601, Dec. 13, 1985, Pat. No. 4,664,377.

[51] Int. Cl.[4] ..... A63D 1/04

[52] U.S. Cl. ..... 273/51

[58] Field of Search ..... 273/51

[56] References Cited

U.S. PATENT DOCUMENTS

| | | | |
|---|---|---|---|
| 359,542 | 3/1887 | Reisky | 273/51 |
| 469,071 | 2/1892 | Worth | 273/51 |
| 471,244 | 3/1892 | Montgomery | 273/51 |
| 490,916 | 1/1893 | Montgomery | 273/51 |
| 631,090 | 8/1899 | Mussey | 273/51 |
| 757,922 | 4/1904 | Herbst | 273/51 |
| 1,511,696 | 10/1924 | Wendt | 273/51 |
| 1,697,800 | 1/1929 | Treiber | 273/51 |
| 1,795,624 | 3/1931 | Treiber | 273/51 |
| 1,921,734 | 8/1933 | Dunlap | 273/51 |
| 2,203,458 | 6/1940 | Federer | 273/51 |
| 2,788,973 | 4/1957 | Grawey | 273/51 |
| 2,946,590 | 7/1960 | Bruner | 273/51 X |
| 2,969,983 | 1/1961 | De Vore | 273/51 |
| 3,014,722 | 12/1961 | Green | 273/51 |
| 4,146,223 | 3/1979 | Stottman | 273/51 |
| 4,269,411 | 5/1981 | Heddon | 273/51 |
| 4,354,678 | 10/1982 | Heddon | 273/51 |
| 4,406,455 | 9/1983 | Berry | 273/51 |

*Primary Examiner*—Anton O. Oechsle

*Attorney, Agent, or Firm*—William H. Eilberg

[57] ABSTRACT

This invention is an improved bowling alley which lasts at least twice as long as bowling alleys of the prior art. The bowling alley has a bowling lane defined by a plurality of staggered boards, the boards being held tightly together between a pair of holding means, or equivalent devices. The holding means are provided with at least one resilient member which allows the boards to expand and contract in response to changes in moisture content, without forming gaps between the boards. At least one strain gauge is also provided on at least some of the holding means, enabling measurement of the amount of expansion of the lane, and thereby providing an indication of whether the boards need humidification or dehumidification. The bowling lane is supported by a plurality of posts, the posts including threaded members which permit the height of the lane to be finely adjusted. The posts are connected to a rigid channel, preferably made of metal, which rests on the floor or other supporting surface. The channel is not nailed or screwed into the floor, but simply rests on that surface. A plurality of floor plates, affixed to the channel, permit vertical adjustment of the channel at various locations. The use of the metal channel makes it feasible to move the bowling alley from one location to another.

17 Claims, 5 Drawing Sheets

BOWLING ALLEY

CROSS-REFERENCE TO PRIOR APPLICATION

This is a continuation-in-part of U.S. patent application Ser. No. 808,601, filed Dec. 13, 1985, now U.S. Pat. No. 4,664,377.

BACKGROUND OF THE INVENTION

The present invention relates to the field of bowling alleys, and discloses a structure which has a longer useful life than any of the bowling alleys of the prior art.

Bowling alleys generally include lanes formed from a large number of narrow boards, the boards being held firmly together to define the bowling surface. A typical bowling lane is constructed of boards having a width of approximately one inch, and a regulation bowling lane is about 41.5 inches wide. Generally, the boards forming the first fifteen feet of the lane are made of hard maple, with the balance of the boards of the lane being constructed of long leaf yellow pine. In this specification, the term "lane" will be used to refer to the bowling surface, i.e. the boards described above, and the term "alley" will be used to refer to the entire structure, including the support means for the lane. Bowling alleys having lanes formed of a plurality of narrow boards have been known for many years. One example of such an alley is shown in U.S. Pat. No. 631,090. The latter patent shows a group of boards or strips, interlocked with each other by a tongue-and-groove construction, and held firmly together by a series of metallic clamps. A similar idea is shown in U.S. Pat. No. 1,697,800, which also provides some vertical adjustability of the bowling surface, through the use of screws located below the surface. U.S. Pat. No. 1,795,624 also discloses a bowling alley constructed from a plurality of narrow boards. And U.S. Pat. No. 1,511,696 discloses still another bowling alley of the same general type, the boards of the bowling lane being held together by a combination of bolts and nails.

One major problem in the maintenance of bowling alleys is caused by absorption of moisture. As the boards forming the bowling lane absorb moisture from the surrounding air, they expand, especially in the transverse direction. The boards later contract when the humidity decreases. If the boards are nailed in place, as is true with most of the bowling lanes presently in use, the expansion causes the boards to separate, forming gaps between adjacent boards. Then, when a bowling ball strikes an edge of one of these boards, a piece of the wood is likely to chip off. This process of chipping is known as "feathering". Feathering can ruin a bowling lane in a relatively short time. The lane is left with crevices, pock marks, and generally undesirable surface features. This damage is quite apparent, even to the untrained eye. Even if the boards of the lane are not nailed in place, absorption of moisture can be problematic. Expansion of the boards can cause the lane to break the clamp, or other holding device, which presses the boards together. And if the clamp does not break, then the edge of the lane may buckle, to accommodate the extra pressure, creating an unwanted slant in the lane surface. Also, the boards may be compressed beyond their elastic limit, so that gaps will form when the humidity is reduced. Such gaps in the lane are likely to cause feathering, as described above. These gaps also act as small reservoirs which undesirably take up some of the oil used in treating the surface of the lane. The gaps make it difficult to apply a film of oil, having a precise thickness, to the surface of the lane.

The damage to a bowling lane due to expansion and contraction of the boards is not just an aesthetic problem. A bowling lane having visible gaps is likely to cause unpredictable and unwanted irregularities in the motion of the bowling ball. Bowling alleys are precisely crafted structures which must meet the standards set by the American Bowling Congress (ABC), which annually inspects bowling alleys throughout the country. If a lane does not pass the inspection, the lane cannot be used for official league and tournament play. Among many other items, an ABC inspection includes an examination of the surfaces of each lane. A spirit level is used to check for crosswise tilt and depressions, and a maximum tolerance of 0.040 inches is permitted.

Even if the bowling lane does not suffer from the effects of changes in humidity, it still suffers damage from normal use. The constant impacts of the bowling balls on the lanes produce small depressions, which eventually must be repaired. The surface of the lane can be sanded down, and sanding is usually done about once every three years. Several sanding operations can cause the removal of from one-sixteenth to one quarter of an inch from the lane.

Sanding of the lane creates its own problems. Because the area near the foul line does not normally suffer much damage due to impact from a bowling ball, this area is not usually sanded. But the repeated sanding of the remainder of the lane creates a slope in the lane. Eventually, the amount of the slope becomes unacceptable, and the lane cannot be sanded further. When this point is reached, it would be helpful to be able to invert the lane, so as to begin again with the surface which originally faced downward. But if, as is true in many of the structures of the prior art, the boards are nailed into their supporting structure, it is impossible to use the underside of the boards in this way.

When a bowling lane which has been damaged by feathering or by repeated impacts of a bowling ball can be sanded no more, it is necessary to replace the lane. This is an expensive undertaking. It currently costs several thousand dollars to replace just one lane. The cost of replacing a full set of lanes is prohibitive, even for a moderately sized bowling establishment.

It is possible to address the moisture problem by impregnating the boards with a glycol-type solution which extracts all moisture and air from the wood. This method will eliminate moisture from the boards, but the method is also very expensive. It is also possible to seal the individual boards against moisture with polyurethane, or another sealing material, but this procedure is also very expensive, and is not completely effective.

The present invention solves the problems described above, and provides an economical structure for a bowling alley, the alley having a greatly increased life expectancy, compared with the bowling alleys of the prior art. The invention also facilitates the inversion of the boards of the lane, so that when one side is finally exhausted, it is possible and practical to use the previously unused surface of the lane. The invention also makes it easy to raise and lower parts of the lane so as to maintain the level character of the lane.

Still another feature of the invention is its ability to be transported to various locations, and yet maintain the rigidity of a conventional, fixed installation. There is disclosed an embodiment of the bowling alley wherein the entire structure is supported on a metal channel, the channel being free of any positive connection to the underlying surface.

SUMMARY OF THE INVENTION

The present invention comprises a bowling alley having a lane which is formed of a plurality of narrow boards. The boards are prevented from moving vertically across each other by a suitable interlocking means, such as a tongue-and-groove construction. The boards are held together, across the width of the lane, by a clamping means, the clamping means including a pair of angle members. Each of the boards has a series of holes, such that when the boards are held together, the holes define internal transverse channels through which a set of rods can be inserted. The ends of the rods are threaded, and inserted through the angle members. A pair of nuts are tightened around the ends of the rods, so that the angle members clamp the boards together. A resilient member, such as a flexible washer, is provided, preferably between each angle member and nut, the resilient member allowing expansion and contraction of the lane.

At least one pressure transducer is disposed on at least one of the rods, between the angle member and the nut which is threaded onto the rod. The transducer generates an electrical signal proportional to the transverse displacement of the lane, and can be connected to a means for humidifying or dehumidifying the boards of the lane, as appropriate.

The bowling lane comprises a plurality of boards, laid end to end. The boards are staggered throughout the length of the lane, so that there are no seams extending across the entire lane. The lane is held above the ground, and is supported by a plurality of C-beams, which in turn rest upon a set of posts. The posts may be anchored in concrete, on the ground, below the lane, but they can also be fastened to a wooden floor. The posts are provided with threaded extension members which can be used to adjust the height of the lane.

In an alternative embodiment, the posts are not anchored in the floor, but instead are fastened to a metal channel which rests upon, but is not attached to, the floor or other supporting surface. A plurality of flat plates are attached to the channel, and make it possible to raise or lower various portions of the channel. With this embodiment, the bowling alley can be more easily transported, since no rigid attachment to an underlying structure is required. This alternative embodiment is especially useful in cases where bowling tournaments are played in a gymnasium, or other similar location, and wherein it is necessary to dismantle the alley immediately after the tournament. The bowling alley of this embodiment is just as sturdy as that of the first embodiment.

In either of the embodiments described above, the lane should be maintained at a height of about 12 inches from the ground, although this height can be varied.

A three-sided insulated wall is provided in the region beneath the lane. This wall, together with the lane itself, defines an enclosure in which atmospheric conditions can be monitored and controlled. At least one moisture sensor is provided, for directly measuring the moisture content of one or more of the boards, and the output of this sensor can be connected to a controller which activates a humidifying or dehumidifying device, as needed. The moisture sensor described above is in addition to the pressure transducers, which also provide indirect indications of the moisture content of the boards.

In another alternative embodiment, the tongue-and-groove interlocks are replaced with splines which fit within semicylindrical grooves formed in adjacent boards. When the boards are clamped together, the grooves deform slightly to form elliptical cross-sections, and the splines are made to fill the entire space within the grooves. This embodiment saves some material costs, by reducing the amount of wood that would be wasted in forming tongues in each board.

In still another alternative construction, the rods can be replaced by metal wires or nylon cords, extending through holes in the boards, and attached to the angle members. The wires or cords pull the angle members together, providing clamping of the boards as before, and their natural flexibility permits the boards to expand and contract without damage.

It is therefore an object of the present invention to provide a bowling alley having a long life expectancy.

It is another object of the invention to provide a bowling alley having a lane which is vertically adjustable.

It is another object to provide a bowling alley wherein diferent portions of the lane can be raised and lowered.

It is another object to provide a bowling alley which is supported on a rigid channel, and wherein said channel is not attached to the floor or other supporting surface.

It is another object to provide a bowling alley which can be moved to various locations, but which enjoys the sturdiness of a conventional fixed installation.

It is another object to provide a bowling alley wherein it is feasible to repair or replace only a part of single lane.

It is another object of the invention to provide a bowling alley wherein the moisture content of the boards can be both directly and indirectly measured.

It is another object of the invention to provide a bowling alley which permits the boards forming the lane to expand and contract, without permanently damaging the boards.

It is another object of the invention to provide a bowling alley wherein the boards of the lane can be easily inverted, so that the boards which originally faced downward can be made to face upward.

It is another object to provide a bowling alley having a construction which does not require nails.

It is another object to provide a bowling alley, the components of which can be disassembled, board by board and bolt by bolt, and packaged for shipment.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
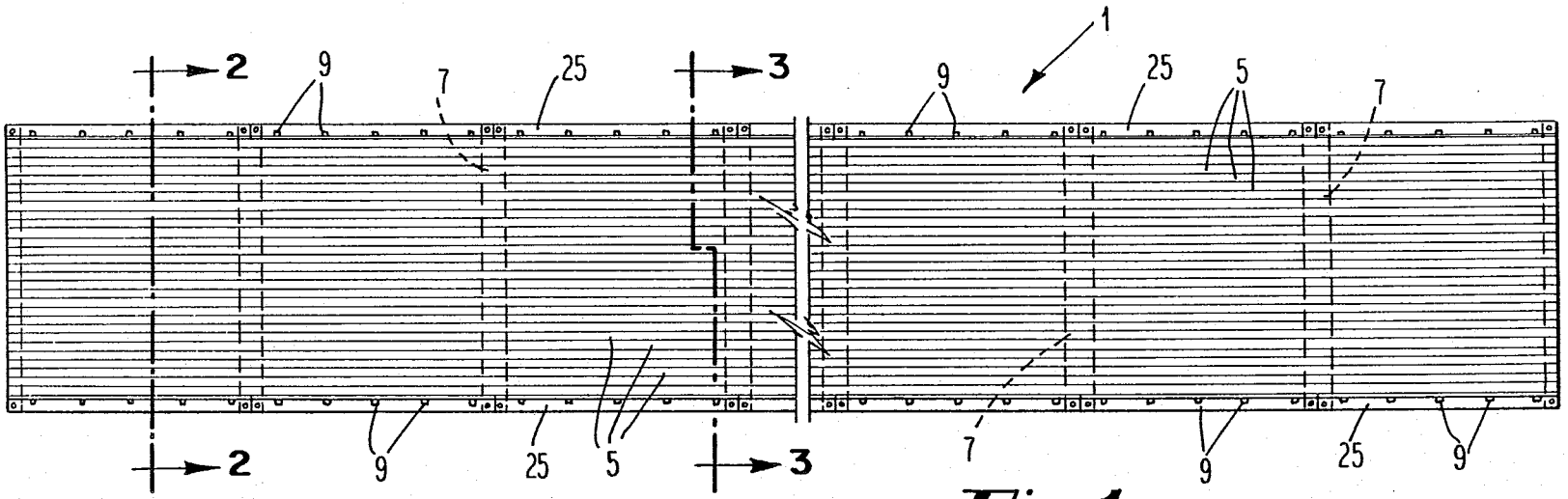
FIG. 1 is a plan view of the bowling alley of the present invention, showing the boards forming the lane, and indicating the position of the rods extending across the width of the lane.
Figure 2:
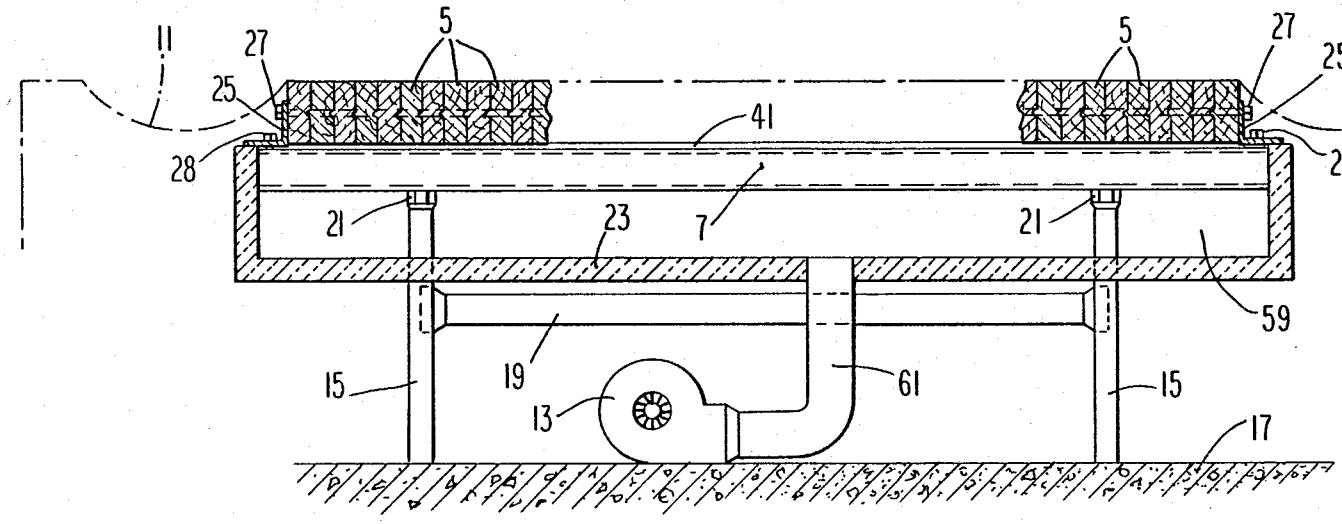
FIG. 2 is a cross-sectional view of the bowling alley, taken along the line 2—2 of FIG. 1, showing the structure of the alley beneath the bowling lane.
Figures 3, 3A:
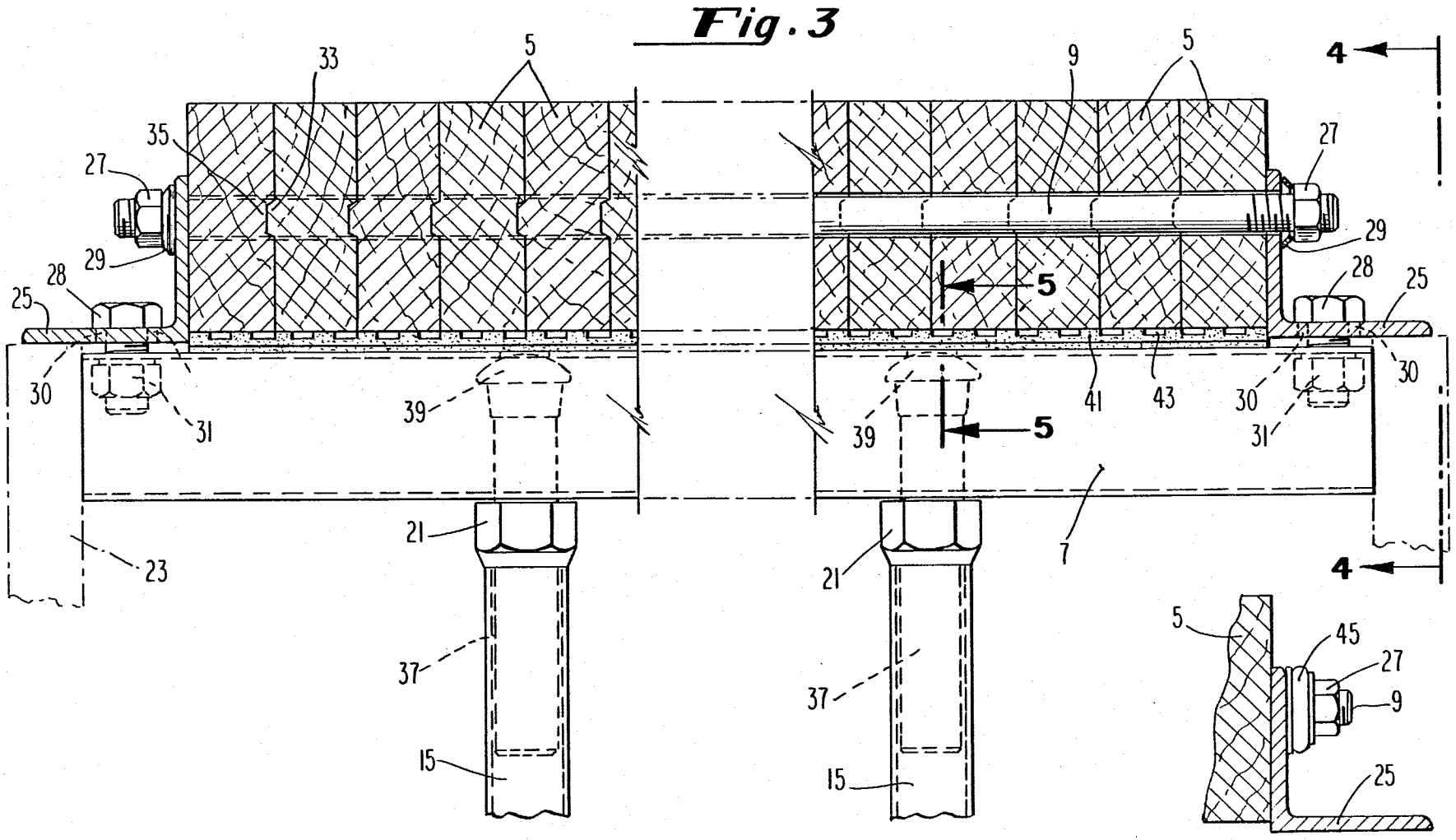
FIG. 3 is a cross-sectional view of the bowling alley, taken along the line 3—3 of FIG. 1, illustrating in detail the manner by which the boards are held together, and also illustrating the means of support for the boards.
FIG. 3*a* is a fragmentary cross-sectional view, showing a pressure transducer which indicates the amount of displacement of the bowling lane, due to changes in moisture content of the boards.
Figure 4:
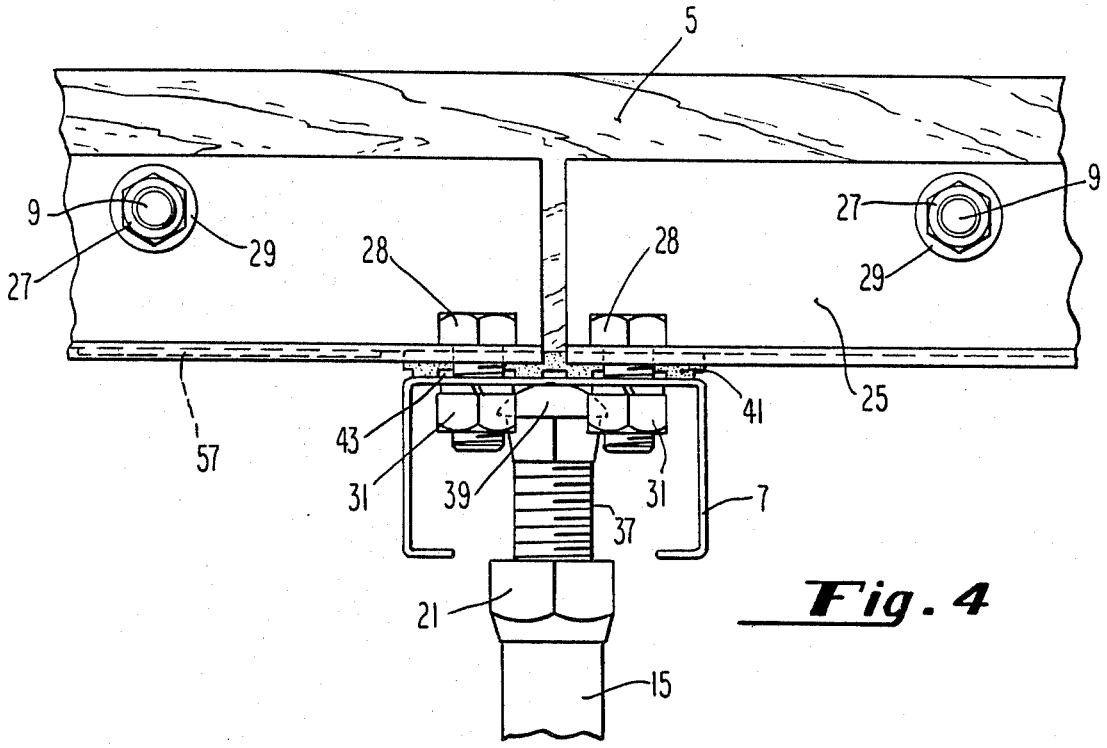
FIG. 4 is a fragmentary side elevational view, taken along the line 4—4 of FIG. 3, showing one of the C-beams which support the bowling lane.

The bowling alley of the present invention is shown in the plan view of FIG. 1, in the cross-sectional views of FIGS. 2 and 3, and in the elevational view of FIG. 4. Bowling alley 1 includes a bowling lane formed from a plurality of boards 5 laid end to end. The plan view of FIG. 1 shows the overall layout of the alley, but does not show the details of its construction. In practice, the boards 5 are staggered throughout the length of the lane, so that there are no seams extending across the entire width of the lane.

FIG. 3 illustrates the construction of the bowling alley in more detail. A plurality of boards 5 are held together between angle members 25. Boards 5 have tongues 33 and grooves 35, which hold the boards in a mating relationship, and which prevent the boards from moving vertically across each other. The boards are drilled with holes in precise locations, so that when the boards are held together to form the lane, the holes are aligned to provide a plurality of transverse internal channels through which rods, such as rod 9, can be inserted. The rod has threaded ends which are designed to receive nuts 27. The rod is inserted through the hole in the boards, and through the angle member 25, and the nuts 27 are screwed onto the ends of the rods. When the nuts are tightened, the angle members clamp the boards together. Resilient washers 29 are placed between angle members 25 and nuts 27. Washers 29 can be Bellville washers, or equivalent devices, which are rugged yet elastic. Such washers have been used in other contexts, and are substantially uniformly resilient about their circumference. The washers 29 therefore allow the boards 5 to expand or contract slightly, in response to changes in the moisture content of the wood.

Angle members 25 are attached to C-beam 7, by bolts 28 and nuts 31. This attachment is such that the C-beam and the angle member cannot move apart vertically, but permits the C-beam and the angle member to slide across each other horizontally. The structure of the C-beam 7 is more clearly illustrated in FIG. 4, and will be described in more detail below.

The boards 5 rest on a flexible mat 41, made of rubber or similar material, the mat having a network of grooves 43, only some of which are visible in FIG. 3. The mat 41 rests on C-beam 7.

The C-beam is supported by posts 15, which includes a threaded extension member 37, a screw member 21, and a support 39. The support contacts the C-beam, and is welded thereto, as will be more fully described below. The posts are preferably made of steel, or other rigid material.

Slot 30 is formed in angle member 25. The slot allows the angle member to slide laterally, to a limited degree, in response to expansion of the boards 5. The apparatus therefore accommodates changes in moisture content of the boards in two ways. The washer 29 permits the vertical portion of angle member 25 to move, and the entire angle member can slide around bolt 28. Nut 31 can be a conventional lock-nut, having a plastic insert to facilitate the movement of the angle member along the C-beam.

As shown in FIG. 3*a*, pressure transducers 45 are disposed around the rods, between some of the angle members 25 and their associated nuts 27. For the sake of clarity, FIG. 3*a* does not also show the washer, but it is understood that all the rods have such washers, or their equivalent.

Transducer 45 can be a conventional strain gauge which generates an electrical signal in response to changes in the pressure exerted by the boards. The output of transducer 45 is therefore an indirect indication of the level of moisture in the boards. Many different types of such transducers are commercially available. Most of the angle members 25 do not have such transducers, however. It is preferable that there be one transducer approximately every fifteen feet along the lane.

The output of the transducer can be displayed on a meter, or by any other conventional display means. The output of the transducer can also be used to control automatically a humidifier and a dehumidifier. The moisture level in the wood should correspond to a relative atmospheric humidity level of about 50%.

The structure of the C-beam, and of the angle members, is more clearly shown in the elevational view of FIG. 4. FIG. 4 shows one of the boards 5, and adjacent angle members 25. C-beam 7 is shown attached to the angle members by bolts 28 and nuts 31. FIG. 4 also shows the rubber mat 41, and shows the grooves 43 formed in the mat. Also shown in FIG. 4 is post 15, with its screw member 21, extension member 37, and support 39. Also visible are nuts 27 and rods 9, as well as washers 29.

Figure 5:
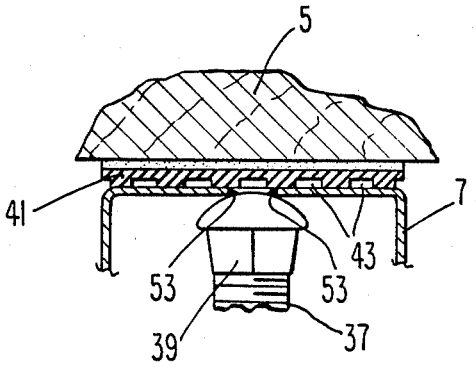
FIG. 5 is a fragmentary cross-sectional view, taken along the line 5—5 of FIG. 3, illustrating the junction of the post, which supports the lane, and the C-beam.

FIG. 5 illustrates more details of the means of support for the bowling lane. Extension member 37 is shown, in fragmentary form, and the support 39 is shown welded to C-beam 7, at weld points 53. FIG. 5 also illustrates the flexible mat 41, and shows the grooves 43 in the mat. As stated above, the mat has a network of grooves, the grooves running both longitudinally and transversely. The longitudinal grooves are shown in FIG. 3; the transverse grooves, in FIG. 4. It is also possible to construct the mat without any grooves at all.

The rod and washer structure shown in FIG. 3 is not the only possible configuration. In an alternative embodiment, the rods 9 can be replaced by flexible wires or nylon cords which are strung between the angle members 25. The wires or cords are placed in tension between the angle members, and hold the boards 5 tightly together. The wires or cords can expand and contract with small changes in the width of the lane. In this embodiment, wawhers 29 are eliminated. What is important is that there be some flexible member to enable the boards to expand and contract without forming gaps between adjacent boards.

The structure of the bowling alley, beneath the lane, is shown more fully in FIG. 2. The figure shows the lane defined by boards 5, flanked by gutters 11. Posts 15 are embedded in concrete material 17, and are braced by cross bars 19. The posts can also be fastened to a wooden floor, to suit the needs of a particular installation. An insulated three-sided wall 23, together with the boards themselves, defines an enclosed region 59 beneath the boards 5. An atmosphere regulator 13, which can include both a conventional air conditioner and a humidifying unit, is disposed below the lane, and supplies humidified or dehumidified air to region 59, through duct 61. The insulation in wall 23 can be fiberglass, or any other equivalent product. Air circulating through region 59 is made to flow along substantially the entire length of the alley, so as to maintain the proper moisture levels for all of the boards 5.

The structure shown in FIG. 2 illustrates another advantage of the invention, as compared with the prior art. In bowling alleys of the prior art, the lane is generally supported by wooden cribbing, formed of boards which are nailed together. The structure disclosed herein requires no nails, and facilitates the assembly and disassembly of the alley. Moreover, different portions of the lane can be raised or lowered slightly, by adjusting the various screw members 21. Thus, it is possible to compensate somewhat for slopes in the lane due to sanding.

Figure 6:
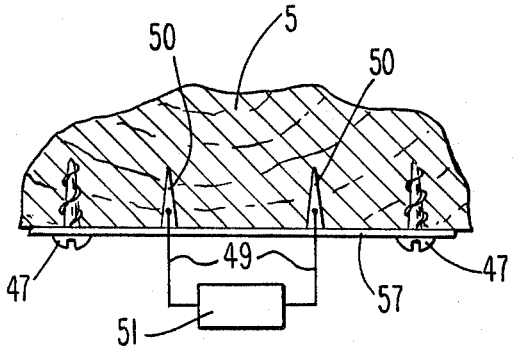
FIG. 6 is a fragmentary cross-sectional view showing a device for directly sensing the moisture content of the boards forming the bowling lane.

Atmosphere regulator 13 is controlled by a signal from a moisture indicator attached directly to one or more of the boards 5. FIG. 6 shows one possible design for the moisture indicator. The indicator comprises plate 57 having sensor pins 50. Plate 57 is inserted, with its pins, into one of the boards 5, and the plate is fastened to the board by wood screws 47. Leads 49 carry an electric current, and the electrical resistance of the wood is measured, and translated into a reading of its moisture content. This reading can be processed by controller 51, which is connected, by conventional circuitry, to activate the atmosphere regulator 13.

The moisture sensor represented by pins 50 and controller 51 is in addition to, and is, independent of, the pressure transducers 45. Both the transducers and the moisture sensor provide indications of the moisture content of the wood, and their outputs can be displayed on a meter, a computer screen, or by any other means, to inform the operator of the bowling alley of the condition of the alley. The outputs of these devices can be connected, in parallel, to control the regulator 13, to correct for extremes in moisture content of the wood. It is understood that other types of moisture sensors can be used.

Figure 7:
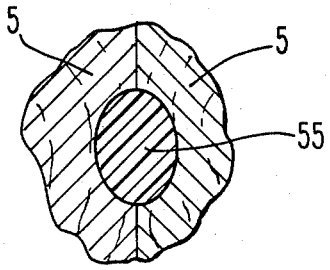
FIG. 7 is a fragmentary cross-sectional view showing an alternative construction for the boards, wherein the boards are joined by splines.

FIGS. 2 and 3 illustrate a tongues-and-groove interconnection of the boards 5. An alternative means of connecting the boards is illustrated in the fragmentary view of FIG. 7. Instead of tongues and grooves, the boards 5 are provided with recesses, having generally semielliptical cross-sections, into which splines 55 are inserted. When the boards are compressed over the splines, the splines are deformed into a generally elliptical cross-section, conforming to that of the recess, as shown in FIG. 7.

An elliptical recess is necessary because it is very difficult, if not impossible, to construct a spline of circular cross-section which will fill exactly all of the space within a cylindrical space. With the elliptical construction shown, the spline is made to fill all the space when the boards are compressed. The embodiment of FIG. 7 has the advantage of saving some material, insofar as the boards do not need to be planed down to form tongues. This embodiment can eliminate several boards from each lane, amounting to a significant saving for large bowling establishments.

Alternative means for connecting the boards can also be used. For example, the space within the recesses can be filled with an initially soft plastic material which hardens with the passage of time. What is important is that the boards not be allowed to move vertically across each other.

Figure 8:
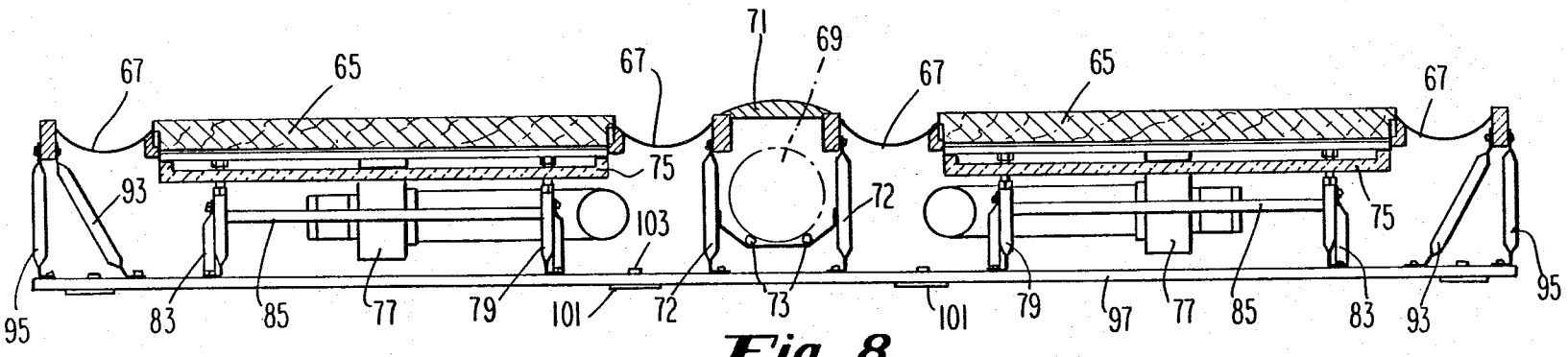
FIG. 8 is a cross-sectional view, taken from the same direction as in FIG. 2, showing an alternative embodiment of the bowling alley, wherein the alley is mounted on a metal channel.
Figure 9:
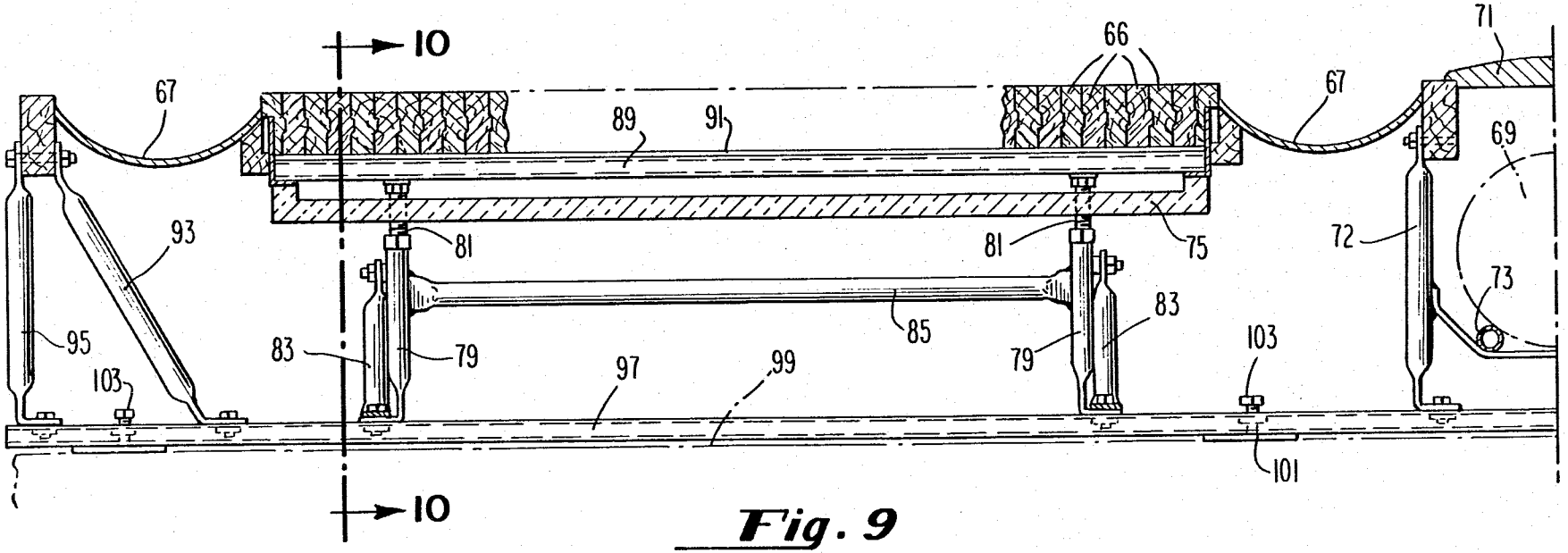
FIG. 9 is a cross-sectional view, taken from the same direction as FIG. 8, showing more details of one of the lanes of FIG. 8.
Figure 10:
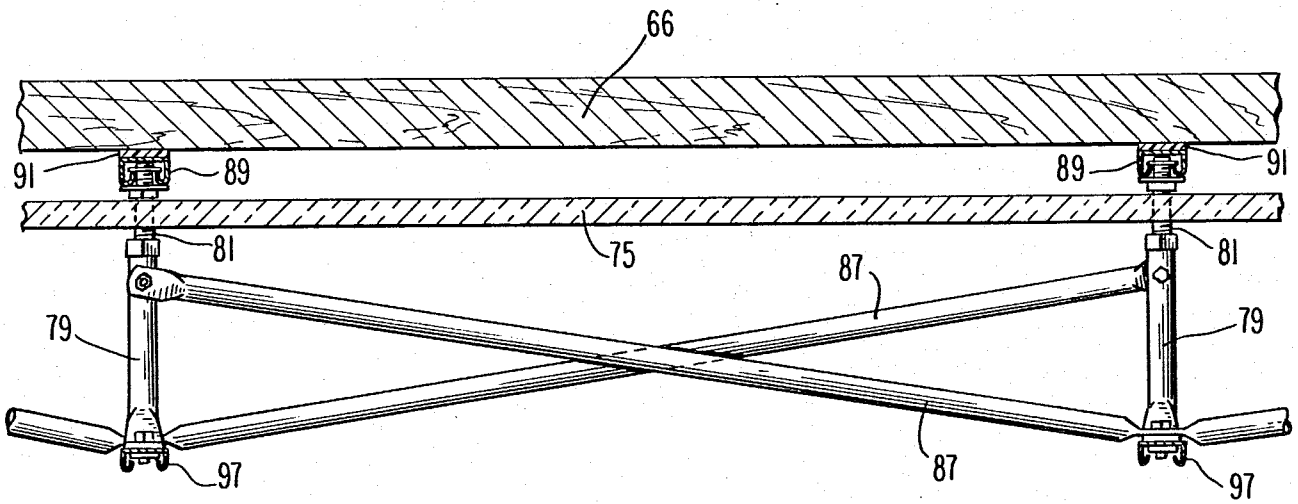
FIG. 10 is a cross-sectional view taken along the line 10—10 of FIG. 9.

An alternative embodiment of the invention is shown in FIGS. 8, 9 and 10. In this embodiment, the bowling alley is mounted on a rigid channel, preferably made of metal. The channel rests on the floor, or other supporting surface, but is not affixed thereto.

FIG. 8 is a cross-sectional view of two lanes made according to this alternative embodiment. FIG. 9 shows the same structure, from the same direction of view, but showing more details of one of the lanes. FIG. 10 is a cross-sectional view, taken along the line 10—10 of FIG. 9.

As in the first embodiment, the alley of the embodiment of FIGS. 8–10 includes lanes 65, formed of a plurality of boards 66, the boards resting upon pads 91 (more clearly shown in FIG. 10) which, in turn, are disposed on support channels 89. The lanes are flanked by gutters 67. A return conduit for bowling ball 69 is defined by ball return brackets 72 and cover 71. The ball travels on guides 73. The gutters on the outer sides of the pair of lanes are supported by angle braces 93 and straight braces 95.

FIGS. 8 and 9 also show insulated wall 75, which helps to define a region of controlled atmospheric conditions, beneath each lane. Blower 77 circulates air through this region, similar to the embodiment described earlier.

As in the first embodiment, the lanes are supported on a plurality of posts 79. The posts have threaded extension members 81, which permit vertical adjustment of various portions of the lane. Each post is disposed adjacent support 83, and the posts and supports are affixed to floor channel 97. The floor channel must be quite rigid, and is preferably made of metal. FIG. 9 shows a floor 99, which can represent any supporting surface.

A plurality of floor plates 101 are attached to floor channel 97. These floor plates engage the channel by screws 103 which are used to adjust the height of the channel relative to the floor plate. The floor plates thus provide additional adjustability, and can be used to compensate for variations in the height of the supporting surface.

Posts 79 are connected by cross-members 85, shown in FIG. 9, and also by braces 87, as shown in FIG. 10. FIG. 10 also shows, in cross-section, support channel 89 and floor channel 97.

In this alternative embodiment, the bowling alley is not affixed to the floor. On the contrary, the lanes and their supporting posts are firmly connected only to the floor channel, which rests freely on the floor. Thus, this embodiment makes it possible to install a full-sized bowling alley on virtually any surface, without disturbing or marring that surface, provided that there is enough area to accommodate the entire alley. This feature is very useful when the bowling alley is to be used for "traveling" tournaments. A full-sized bowling alley can be assembled, for example, in a gymnasium, without causing harm to the polished floor, and the alley can be disassembled and removed following the tournament. However, during use, the bowling alley is just as sturdy as a conventional alley which is anchored permanently in the ground.

The embodiment of FIGS. 8–10 can also be used in cases where portability is not necessary. The embodiment has the advantage that, due to the plurality of floor plates, it can be more finely adjusted to compensate for variations in the height of the surface.

The present invention, in either embodiment, makes it comparatively easy to invert the bowling lane, and to use the previously unused surface. It is only necessary to unfasten the bolts 28 when performing this operation. The entire lane can be lifted up, without loosening the nuts 27, or other means of fastening, and can be turned over in one operation. The angle members 25 can then be rotated about the rods 9, and reattached to the C-beams 7 by bolts 28 and nuts 31. This operation is made simple by the fact that the boards of the lane are not nailed or otherwise directly fastened to the supporting C-beams, but merely rest upon the C-beams. The boards are connected firmly to the C-beams through the bolts which join the angle members to the C-beams, but these bolts can be removed and refastened with comparative ease.

The bowling alley disclosed has the additional advantage that it can be disassembled, bolt by bolt, and board by board, and packed for shipment. Because no nails are required for holding the boards together, or for constructing the supporting structure beneath the lane, it is possible to dismantle the entire alley without damage to its components. The disassembly process involves mainly the loosening of nuts, such as nuts 31. The individual boards can also be disassembled, by unfastening nuts 27. The alley can easily be reassembled, again without substantial harm to any of its parts.

The bowling alley of the present invention also has the advantage that it is feasible to repair or replace only a part of a single lane. This feature arises from the fact that no nails are used to fasten the boards of the lane to the supporting structure. In practice, the portion of the lane which receives the most wear is the "head" portion, i.e. the area onto which the ball is dropped. It is economical to repair or replace only the boards in the head portion, without disturbing the remaining boards.

In the present invention, the flexible washer, or other equivalent flexible member, is provided to permit expansion of the boards in the transverse direction. It turns out that changes in size in the longitudinal direction are not a serious problem, and it is not necessary to provide means for relieving longitudinal stresses.

The bowling alley described will last far longer than those of the prior art. Because the boards are protected from damage from separation due to moisture, each lane lasts much longer. And because the lane can be inverted, the life of the alley is prolonged even more. It is apparent that the alley described above will last more than twice as long as conventional bowling alleys.

While the invention has been described with respect to the particular embodiments illustrated, it is understood that the invention can be modified in many ways. As stated above, another type of resilient means can be substituted for the flexible washer which allows the boards of the lane to expand. A nylon cord or wire can be substituted, as described above. The resilient means could even by a hydraulic or pneumatic cylinder.

The means of attachment of the boards to each other can be varied. The placement, types, and numbers of the pressure sensors can be changed, and the invention can be used with or without the additional moisture sensor which is shown connected directly to the wood. These and other modifications are to be deemed within the spirit and scope of the following claims.

What is claimed is:

1. A bowling alley, comprising:

(a) a plurality of boards, each of the boards having holes, the boards being held together between two angle members, to form a bowling lane, the boards being held so that the holes are aligned to form passages extending through the boards, (b) at least one rod disposed within a passage, the rod extending through holes in the angle members, the rod having nut means disposed on both ends of the rod, wherein the tightening of the nut means along the rod causes the angle members to clamp the boards together, wherein there is at least one resilient member, disposed on the rod, the resilient member permitting expansion and contraction of the boards, (c) the boards and rods being supported on a plurality of horizontally disposed beams, (d) the beams being held by a plurality of vertical support means, the beams being held in an elevated position above the ground, the vertical support means including vertically adjustable extension means for varying the height of the beams above the ground, the support means being affixed to at least one rigid floor channel, the floor channel being free of any connection to a surface on which the bowling alley rests, (e) enclosure means defining an insulated region beneath the boards, and means for regulating the atmosphere in said region, and (f) means for monitoring the humidity levels in the boards, the monitoring means being connectable to the atmosphere regulating means.

2. The bowling alley of claim 1, wherein the resilient member comprises a convex metallic washer.

3. The bowling alley of claim 2, wherein the washer is substantially uniformly resilient about its circumference.

4. A bowling alley, comprising:

(a) a plurality of boards, and means for holding the boards tightly together to form at least part of a bowling lane, (b) rod means, extending through the lane, the ends of the rod means being connected to the holding means, (c) spring means for allowing the boards of the lane to expand and contract within the holding means, in response to small changes in the size of the boards, (d) the boards being held by support means, the support means being affixed to at least one rigid channel, the channel being free of any connection to a surface on which the bowling alley rests, the bowling alley further comprising a plurality of floor plates, the floor plates being connected to at least one channel, each of the floor plates including means for adjusting the vertical position of the channel, at the position of each floor plate.

5. A bowling alley, comprising:

(a) a plurality of boards, and means for holding the boards tightly together to form at least part of a bowling lane, (b) rod means, extending through the lane, the ends of the rod means being connected to the holding means, (c) spring means for allowing the boards of the lane to expand and contract within the holding means, in response to small changes in the size of the boards, (d) the boards being held by support means, the support means being affixed to at least one rigid channel, the channel being free of any connection to a surface on which the bowling alley rests, wherein the spring means is disposed around the rod means, and wherein the spring means is substantially uniformly resilient about the circumference of the rod means.

6. A bowling alley, comprising:

(a) a plurality of boards, and means for holding the boards tightly together to form at least part of a bowling lane, (b) rod means, extending through the lane, the ends of the rod means being connected to the holding means, (c) spring means for allowing the boards of the lane to expand and contract within the holding means, in response to small changes in the size of the boards, (d) the boards being held by support means, the support means being affixed to at least one rigid channel, the channel being free of any connection to a surface on which the bowling alley rests, the bowling alley further comprising an insulated wall means, disposed beneath the boards of the lane, the wall means and the boards defining a substantially closed region adjacent the boards.

7. The bowling alley of claim 6, including atmosphere regulation means, connected to regulate the condition of the air in said closed region.

8. An improved bowling alley comprising a plurality of boards, the boards being held firmly together by a clamping means, to define a bowling lane, wherein the clamping means includes resilient means for permitting the boards to expand and contract in the transverse direction, while maintaining a transverse clamping pressure on the boards, the boards thereby being prevented from moving apart and forming gaps, due to changes in their moisture content, the bowling alley being held by a support means, the support means resting on a support surface, wherein the support means is free of any connection to the surface, wherein the support means includes at least one rigid floor channel, wherein the floor channel includes a plurality of floor plates, the floor plates being affixed to the floor channel, the floor plates including means for adjusting the height of the floor channel relative to the surface.

9. The bowling alley of claim 8, further comprising wall means, located beneath the lane, the wall means and the lane defining a substantially closed region within which the atmosphere can be controlled.

10. An improved bowling alley comprising a plurality of boards, the boards being held firmly together by a plurality of clamping means, to define a bowling lane, the clamping means including resilient means for permitting the boards to expand and contract in the transverse direction, without forming gaps between adjacent boards, at least one of the clamping means including pressure sensing means for monitoring the transverse pressure exerted by the boards, the bowling alley being supported on at least one rigid support means, the support means being disposed on a surface, the support means being free of any connection to said surface, wherein the support means includes at least one metal channel, wherein the metal channel includes a plurality of floor plates, the floor plates being affixed to the channel, the floor plates including means for adjusting the height of the channel relative to the surface.

11. The bowling alley of claim 10, wherein the support means further comprises a plurality of vertically-adjustable posts, the posts being disposed between the boards and the channel.

12. The bowling alley of claim 11, wherein the resilient means are disposed around rod means inserted through the boards, and wherein the resilient means are substantially uniformly resilient about the circumference of the rod means.

13. An improved bowling alley comprising a plurality of boards defining a bowling lane, the bowling lane being supported by a plurality of rigid floor channels extending transversely across the lane, wherein there are a plurality of such floor channels spaced apart from each other along the length of the lane, the floor channels resting on a surface, the floor channels being free of any connection to said surface, the floor channels being connected to the lane by a plurality of vertically adjustable support members, the support members being disposed between the boards of the lane and the floor channels, and a plurality of floor plates, the floor plates being affixed to the floor channels, the floor plates including means for adjusting the height of the floor channels relative to the surface.

14. The bowling alley of claim 13, wherein pairs of adjacent support members, connected to adjacent channels, are connected to each other by braces.

15. The bowling alley of claim 13, wherein the channels are made of metal.

16. The bowling alley of claim 13, wherein there are at least two floor plates affixed to each floor channel, and wherein there are at least two support members connected to each floor channel.

17. An improved bowling alley comprising a plurality of boards defining a bowling lane, the bowling lane being supported by a plurality of rigid floor channels extending transversely across the lane, wherein there are a plurality of such floor channels spaced apart from each other along the length of the lane, the floor channels resting on a surface, the floor channels being free of any connection to said surface, each of the floor channels being connected to the lane by at least two vertically adjustable support members, the support members being disposed between the boards of the lane and the floor channels, and at least two floor plates, the floor plates being connected to the floor channels, the floor plates including means for adjusting the height of the floor channels relative to the surface.

* * * * *